US005205003A

United States Patent [19]

Green

[11] Patent Number: 5,205,003

[45] Date of Patent: Apr. 27, 1993

[54] RELEASABLE DUST RUFFLE ARRANGEMENT

[76] Inventor: Jayne E. Green, 5801 NE. 17th Ave., Fort Lauderdale, Fla. 33334

[21] Appl. No.: 947,473

[22] Filed: Sep. 21, 1992

[51] Int. Cl.[5] ..... A47G 9/04

[52] U.S. Cl. ..... 5/493; 5/923

[58] Field of Search ..... 5/493, 482, 923, 907; D6/595, 596, 602, 606

[56] References Cited

U.S. PATENT DOCUMENTS

| | | | |
|---|---|---|---|
| 2,139,980 | 12/1938 | Simon | 5/493 |
| 2,245,779 | 6/1941 | Heil | 5/493 |
| 2,619,658 | 12/1952 | Weinberg | 5/493 |
| 2,763,875 | 9/1956 | Piontkowski | 5/493 |
| 4,488,323 | 12/1984 | Colburn | 5/496 |
| 4,587,683 | 5/1986 | Gardiner | 5/493 |
| 4,787,366 | 11/1988 | Bell | 5/493 |
| 5,042,099 | 8/1991 | Brenner et al. | 5/502 |
| 5,086,531 | 2/1992 | Carlos | 5/493 |
| 5,092,010 | 3/1992 | Wong | 5/496 |

*Primary Examiner*—Alexander Grosz
*Attorney, Agent, or Firm*—Oltman and Flynn

[57] ABSTRACT

A releasable dust ruffle arrangement for a bed comprising a box spring; a cover member disposed on top of the box spring, the cover member having two sides, a top and a first and second end, at least one dust ruffle extending along the sides along the first end and extending from each of the sides inward a given distance along the second end; and hook and loop fastener means extending along the dust ruffle between the dust ruffle and the cover member for releasably attaching the ruffle to the cover member.

7 Claims, 1 Drawing Sheet

RELEASABLE DUST RUFFLE ARRANGEMENT

The invention relates to a releasable dust ruffle arrangement for a bed and more particularly to a releasable dust ruffle arrangement attached to a cover member of a bed by means of hook-and-loop type fasteners, or the like.

BACKGROUND OF THE INVENTION

It is known to attach a so-called dust ruffle to the sides of a bed. It is also known to make such a dust ruffle detachable so that it can be easily removed for washing and cleaning.

U.S. Pat. No. 5,086,531 shows a dust ruffle with separable fastener attached to a box spring of a bed.

U.S. Pat. No. 4,587,683 shows a zip-on, zip-off dust ruffle for a bed which includes a cover member fitted around the opposite ends of a bed box spring and has a slide fastener along the edges for attachment of the dust ruffle.

The known types of dust ruffles have the drawback that they are somewhat difficult to put on and take off.

It is accordingly an object of the instant invention to provide a dust ruffle arrangement which overcome the drawbacks of the known dust ruffles and provides a dust ruffle arrangement that is easily detachable and is adjustable in height so as to completely cover the box spring.

SUMMARY OF THE INVENTION

According to the invention there is provided a releasable dust ruffle arrangement for a bed comprising a box spring; a cover member disposed on top of the box spring, the cover member having two sides, a top and a first and second end, at least one dust ruffle extending along the sides along the first end and extending from each of the sides inward a given distance along the second end; and hook and loop fastener means extending along the dust ruffle between the dust ruffle and the cover member for releasably attaching the ruffle to the cover member.

According to a further feature of the invention, there is provided in the arrangement at least an upper dust ruffle and a lower dust ruffle, the upper and lower dust ruffle each having an upper and lower edge and wherein the lower edge of the upper dust ruffle overlaps the upper edge of the lower dust ruffle, and wherein further the hook and loop fastener means include an upper strip of hook or loop fastener material disposed along the upper edge of the upper dust ruffle with a given setback from the upper edge of the upper dust ruffle.

The invention may further include a lower strip of hook or loop fastener material disposed along the upper edge of the lower dust ruffle, and wherein the upper strip of the hook or loop material has a given width to allow vertical adjustment of the upper edge of the upper dust ruffle.

According to still another feature, the invention includes in the hook and loop fastener means a first strip of one of hook and loop fastener material attached to the cover member and a second strip of loop and hook fastener material complementary to the first strip of hook and loop material, attached to the dust ruffle, and wherein further the box spring has a lower surface, and the lower edge of the lower ruffle is aligned with the floor, and wherein the dust ruffle is made of decorative fabric.

Further objects and advantages of this invention will be apparent from the following detailed description of a presently preferred embodiment which is illustrated schematically in the accompanying drawings.

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation.

DESCRIPTION OF THE PREFERRED EMBODIMENTS

Figure 1:
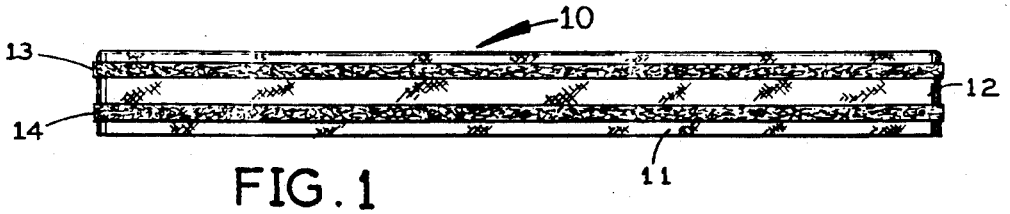
FIG. 1 is an elevational side view of the box spring with a cover member on top of the box spring.

FIG. 1 is a side view of a bed 10 composed of a box spring 11 and a cover member 12 on top of the box spring. The cover member 12 covers the top of the box spring and has two sides and two ends which hang part way down the sides of the box spring 11.

Two strips 13,14 of one part of Velcro® material, also known as hook and loop fastening material are attached to the cover member of which the upper strip 13 is wider than the lower strip 14.

One or two dust ruffles 16,17 are attached by means of the hook and loop fastening material to the cover member 12, such that the upper dust ruffle 16 overlays with its lower edge 18 (See FIG. 3) the upper edge 19 of the lower dust ruffle 17.

Figure 2:
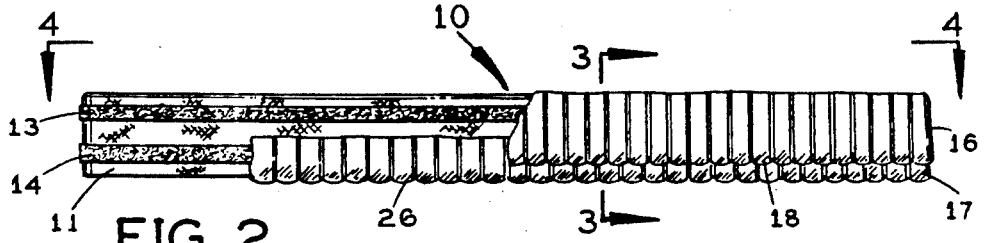
FIG. 2 is an elevational side view according to FIG. 1 showing the dust ruffle arrangement with parts of the dust ruffle material removed to show the position of the upper and lower dust ruffles.

In FIG. 2 part of each dust ruffle is shown removed to clearly show the overlap of the lower ruffle 17 by the upper ruffle 16.

Figure 3:
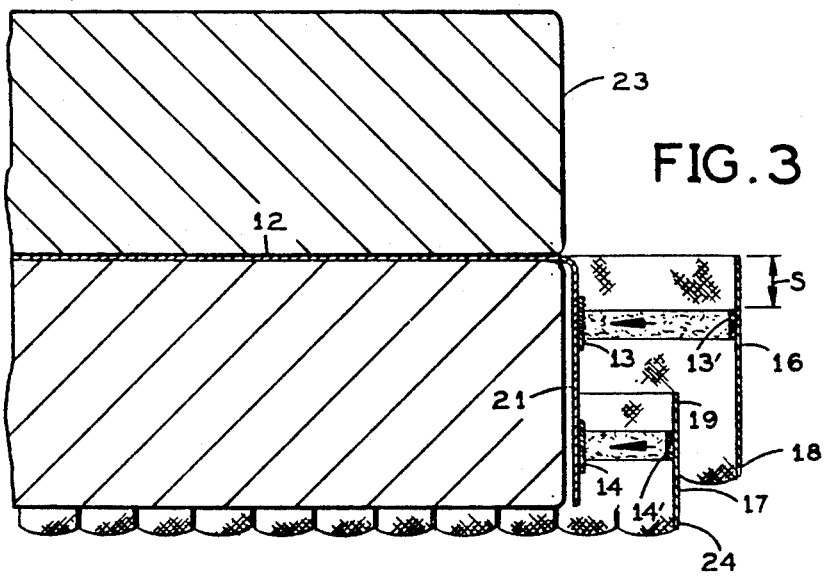
FIG. 3 is a fragmentary cross-sectional detail of a bed seen along the line 3—3 of FIG. 2.

FIG. 3 is a fragmentary elevational cross-section, seen along the line 3—3 of FIG. 2, of the bed 10, wherein the arrangement of the upper dust ruffle 16 has a lower edge 18 overlapping the upper edge 19 of the lower ruffle 17.

The upper fixed strip 13 of the inner part of the hook and loop material is shown attached to the vertical side 21 of the cover 12, while the complementary part 13' is shown attached to the upper dust ruffle 16, advantageously with a small set back "S" from the upper edge 22 of the upper dust ruffle 16. The fixed strip 13 of the hook and loop material is made wider than the complementary part 13' so that the upper dust ruffle can be adjusted vertically in order to insure that the upper edge 22 of the upper ruffle 16 can be aligned with the lower edge of the mattress 23 placed on top of the cover member 12.

The lower strip of hook and loop material is shown as the fixed strip 14 mating with the complementary strip 14' attached to the upper edge 19 of the lower dust ruffle 17. The lower edge 24 of the lower dust ruffle 17 is arranged to be aligned with the floor. The fixed strip 14 is made wider than the complementary part 14' so that the lower dust ruffle can be adjusted vertically.

Figure 4:
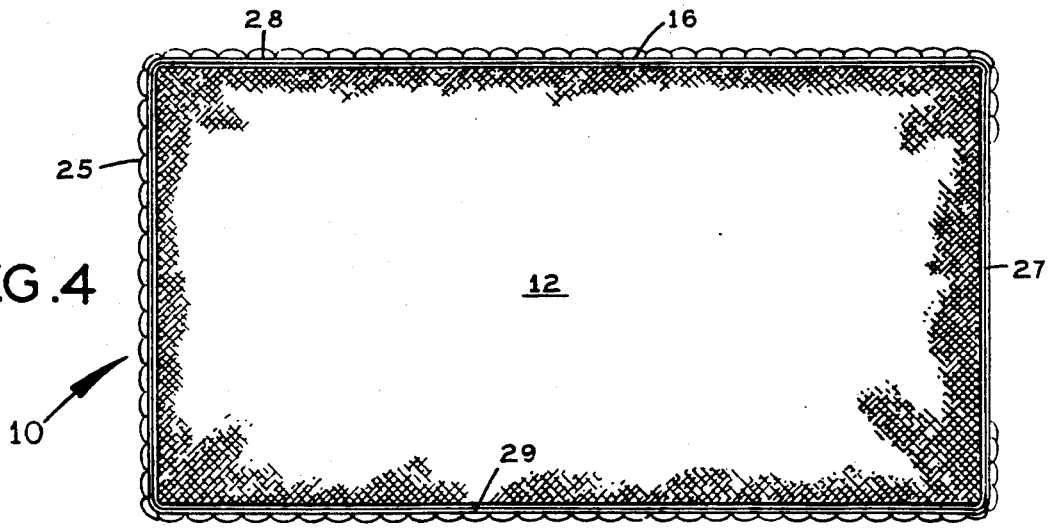
FIG. 4 is a plan top-down view, seen along line 4—4 of FIG. 2, of a bed with the dust ruffle attached thereto.

FIG. 4 is a plan, top-down view of the top base 12 showing the upper ruffle 16 extending from one end 27 of the cover member 12 showing the upper ruffle 16 extending from one end 27 of the top base 12, along one side 28, along the other end 25, along the opposite side 29 back to the first end 27 and extending a short distance inward on the first end 27 from the sides 28,29.

The two dust ruffles 16,17 can, for the sake of appearance, be made pleated as seen in FIG. 2, and can advantageously be made of decorative fabric.

It follows that the dust ruffles 16 and 17 can easily be removed from the cover 12, due to the releaseability of the hook and loop material used for fastening, so that the ruffles can be washed or cleaned as required, and again be put back in place.

I claim:

1. A releasable dust ruffle arrangement for a bed comprising a box spring; a cover member disposed on top of the box spring, the cover member having two vertical sides, a top, and a first and second end, at least an upper dust ruffle and a lower dust ruffle extending along said sides and along said first end and extending from each of said sides inward a given distance along said second end; said upper and lower dust ruffle each having an upper and lower edge and wherein the lower edge of the upper dust ruffle overlaps the upper edge of the lower dust ruffle, and hook and loop fastener means extending along said dust ruffles between said dust ruffles and said vertical sides of said cover member for releasably attaching said dust ruffle to said cover member.

2. An arrangement according to claim 1, including in said hook and loop fastener means an upper strip of hook or loop fastener material attached to said upper dust ruffle and disposed along said upper edge of said upper dust ruffle with a given setback from said upper edge of said upper dust ruffle.

3. An arrangement according to claim 2 including a lower strip of hook or loop fastener material attached to said lower dust ruffle and disposed along said upper edge of said lower dust ruffle.

4. An arrangement according to claim 1 wherein said hook or loop fastener material has a given width to allow vertical adjustment of said dust ruffles.

5. An arrangement according to claim 1, including in said hook and loop fastener means a first strip of one of hook and loop fastener material attached to said cover member, and a second strip of loop and hook fastener material complementary to said first strip of hook and loop material, attached to said upper dust ruffle, said first strip of one of hook and loop fastener material having a given width greater than the width of said second strip of loop and hook fastener material.

6. An arrangement according to claim 1, wherein said box spring has a lower surface, and said lower edge of said lower ruffle is aligned with the floor.

7. An arrangement according to claim 1, wherein said dust ruffle is made of decorative fabric.

* * * * *